US010759133B2

(12) United States Patent
Capoia

(10) Patent No.: US 10,759,133 B2
(45) Date of Patent: Sep. 1, 2020

(54) MACHINE FOR AUTOMATICALLY MANUFACTURING CUSTOMIZED PACKAGING ITEMS

(71) Applicant: INTERNATIONAL BOXES S.R.L., Cimadolmo (IT)

(72) Inventor: Giuseppe Capoia, Cimadolmo (IT)

(73) Assignee: INTERNATIONAL BOXES S.R.L., Cimadolmo (TV) (IT)

( * ) Notice: Subject to any disclaimer, the term of this patent is extended or adjusted under 35 U.S.C. 154(b) by 256 days.

(21) Appl. No.: 15/735,494

(22) PCT Filed: Jun. 7, 2016

(86) PCT No.: PCT/IB2016/053318
§ 371 (c)(1),
(2) Date: Dec. 11, 2017

(87) PCT Pub. No.: WO2016/203343
PCT Pub. Date: Dec. 22, 2016

(65) Prior Publication Data

US 2018/0162083 A1 Jun. 14, 2018

(30) Foreign Application Priority Data

Jun. 15, 2015 (IT) ..... 10201523640

(51) Int. Cl.
*B65B 59/00* (2006.01)
*B31B 50/00* (2017.01)
(Continued)

(52) U.S. Cl.
CPC ..... *B31B 50/006* (2017.08); *B31B 50/07* (2017.08); *B31B 50/106* (2017.08);
(Continued)

(58) Field of Classification Search
CPC ..... B31B 50/44; B31B 2100/00
See application file for complete search history.

(56) References Cited

U.S. PATENT DOCUMENTS 4,988,331 A * 1/1991 Boisseau ..... B31B 50/00 493/171
5,024,641 A * 6/1991 Boisseau ..... B31B 50/00 493/143

(Continued)

FOREIGN PATENT DOCUMENTS

EP 2363280 A1 * 9/2011 ..... B31B 50/00
EP 2363280 A1 9/2011
GB 2274804 A 8/1994

*Primary Examiner* — Andrew M Tecco
*Assistant Examiner* — Eyamindae C Jallow
(74) *Attorney, Agent, or Firm* — R. Neil Sudol; Henry D. Coleman

(57) ABSTRACT

A machine for automatically manufacturing customized packaging items (I) from continuous laminar material, comprising at least one cutting and creasing unit (2) to form sheets (F) of laminar material with a plurality of cuttings and/or bendinglines (C), at least one variable-geometry forming unit (5) for forming the sheet (F) so cut and creased into a package (I) of predetermined dimensions, a multifunctional robotized manipulator (24) for automatically picking up one sheet (F) at a time from the cutting and creasing unit (2) and feeding the forming unit (5), the manipulator (24) being designed to automatically adapt to the predetermined dimensions of the packaging (I) on the forming unit (5) and interact therewith to form the packaging (I).

9 Claims, 8 Drawing Sheets

(51) Int. Cl.

| | |
|---|---|
| ***B31B 50/16*** | (2017.01) |
| ***B31B 50/46*** | (2017.01) |
| ***B31B 50/07*** | (2017.01) |
| ***B31B 50/62*** | (2017.01) |
| ***B65B 5/02*** | (2006.01) |
| ***B31B 50/10*** | (2017.01) |
| ***B31B 50/14*** | (2017.01) |
| *B31B 110/35* | (2017.01) |
| *B31B 100/00* | (2017.01) |
| *B31B 50/44* | (2017.01) |
| *B31B 50/81* | (2017.01) |
| *B31B 120/10* | (2017.01) |
| *B31B 50/04* | (2017.01) |
| *B31B 120/70* | (2017.01) |

(52) U.S. Cl.

CPC ..... *B31B 50/142* (2017.08); *B31B 50/16* (2017.08); *B31B 50/46* (2017.08); *B31B 50/624* (2017.08); *B65B 5/024* (2013.01); *B65B 59/00* (2013.01); *B31B 50/046* (2017.08); *B31B 50/44* (2017.08); *B31B 50/81* (2017.08); *B31B 2100/00* (2017.08); *B31B 2100/0024* (2017.08); *B31B 2110/35* (2017.08); *B31B 2120/102* (2017.08); *B31B 2120/70* (2017.08); *B65B 2210/04* (2013.01)

(56) References Cited

U.S. PATENT DOCUMENTS

| | | | | |
|---|---|---|---|---|
| 5,940,926 | A * | 8/1999 | Inzinna | B08B 15/002 15/301 |
| 7,823,367 | B2 * | 11/2010 | Boigues | B65B 59/02 53/456 |
| 9,027,315 | B2 * | 5/2015 | Tsutsumi | B65B 43/305 53/381.1 |
| 2004/0063559 | A1 * | 4/2004 | Ochsenbauer | B31F 1/0019 493/427 |
| 2008/0020916 | A1 * | 1/2008 | Magnell | B65B 5/02 493/65 |
| 2009/0205929 | A1 * | 8/2009 | DeGuglielmo | B65B 5/024 198/347.1 |
| 2013/0108408 | A1 * | 5/2013 | Saison | B65H 3/0816 414/797 |
| 2014/0371045 | A1 * | 12/2014 | Bruneau | B65H 3/0816 493/52 |
| 2015/0119216 | A1 * | 4/2015 | Benterman | B65B 59/02 493/22 |
| 2016/0185475 | A1 * | 6/2016 | Pettersson | B65B 59/02 53/493 |
| 2019/0002137 | A1 * | 1/2019 | Pettersson | B65B 59/02 |

* cited by examiner

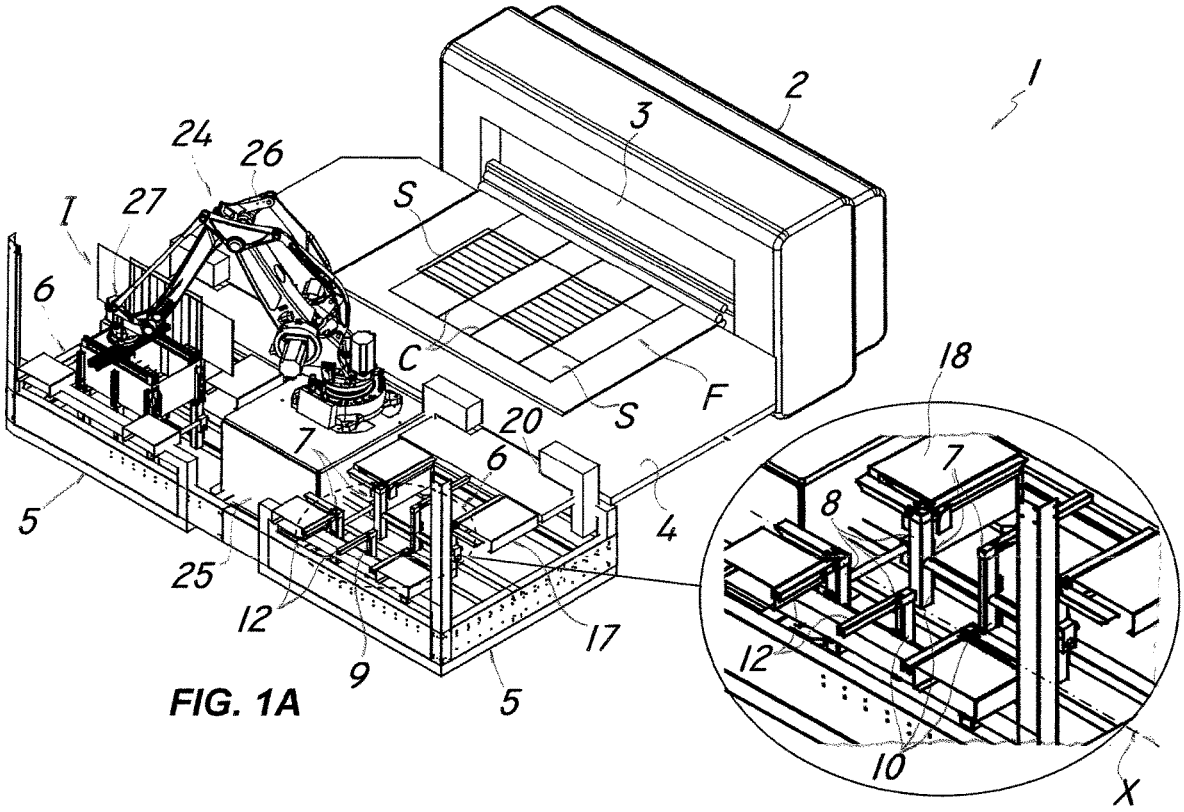
FIG. 1A
FIG. 1B
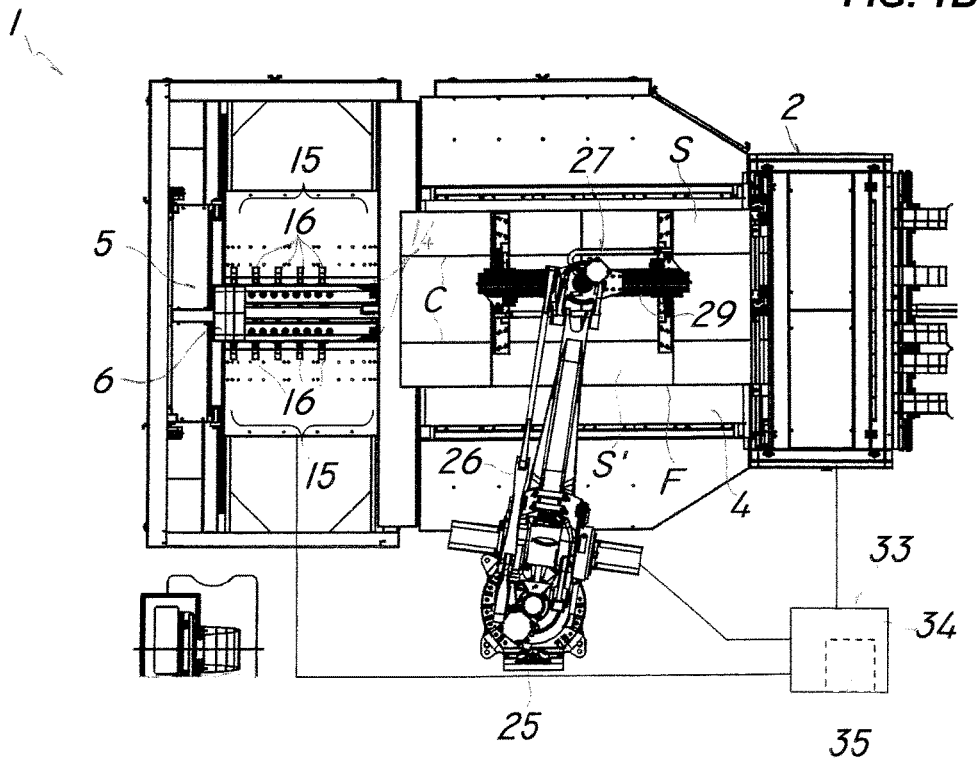
FIG. 2

MACHINE FOR AUTOMATICALLY MANUFACTURING CUSTOMIZED PACKAGING ITEMS

FIELD OF THE INVENTION

The present invention generally finds application in the field of creation of packages and boxes, and particularly relates to a machine for automatically manufacturing customized packaging items, preferably made of corrugated cardboard or the like.

BACKGROUND ART

Systems or machines are known in the art of packaging, for creating packages having predetermined dimensions, and adapted to contain one or more items to be shipped or stored.

These machines can create a package from a sheet of base material, e.g. corrugated cardboard or the like.

Particularly, most of these machines can create a substantially box-like package by appropriately shaping a previously cut and creased sheet.

Therefore, all of these arrangements suffer from the drawback that the cardboard must be first submitted to a cutting and creasing step, to be carried out in a machine external to the system, often located in other factories or departments.

Nevertheless, some systems afford adjustment of certain internal members thereof, to form packages with variable dimensions.

EP2697124 discloses an apparatus for creating cardboard containers of variable sizes. This apparatus comprises a forming station with a frame composed of a pair of longitudinal members that slidingly support a plurality of plate-like forming tools, which are designed to delimit the forming area. The forming area has the same size as the package to be created, and the frame also comprises a pair of transverse members that slidingly support the longitudinal members to change the distance therebetween in a predetermined range from minimum to maximum values. By appropriate adjustment of the longitudinal distance between the tools and the transverse distance between the longitudinal members, the dimensions of the forming area may be changed to form packages of variable dimensions.

A first drawback of this arrangement is that the distances between the longitudinal members and the tools must be manually adjusted by an operator, which involves long downtimes and a dramatic reduction of throughput.

Furthermore, this apparatus has no pressure means for interacting with the cavity and shape the package, whereby the formation of the box requires the installation of pushing systems external to the apparatus and interacting with the die.

In view of at least partially obviating these drawbacks, package-forming systems have been developed, that can automatically and autonomously change the dimensions of the box.

AU20154060 discloses a system for forming cardboard boxes, which comprises a die having a cubic cavity, delimited by four corner elements that are slidingly mounted to respective straight guides. An actuator is placed at the top of the die, and is able to vertically move between a lifted position, in which it is outside the cavity, to a lowered position in which it is within the cavity.

Once the sheet has been cut and creased, it is placed on top of the die when the actuator is in the lifted position, and as the latter is lowered, the sheet is gradually pushed into the die to thereby form a box-like enclosure due to the interaction exerted by the corner elements with its outer surface.

Driving means are associated with the corner elements for promoting controlled movement thereof toward or away from each other to change the dimensions of the die.

Furthermore, the actuator has a pair of projecting appendices, that can be controllably moved to change the plan projection of the actuator for mating and synchronization thereof with the dimensions of the die.

The main drawback of this arrangement is that the cut and creased sheet must be manually placed on the die, whereby the package-forming process is actually semiautomatic.

Furthermore, the package must be also manually removed from the die, which will further reduce the throughput of the system.

An additional drawback of this arrangement is that the wings of the actuator can be adjusted within a limited range, and as a result the system can create packages whose dimensions are variable within a small adjustment range.

Also, an important drawback of this arrangement is that the apparatus can create boxes having an open bottom or an open sidewalk, that are required to be manually closed using adhesive tape or glue, before introducing the material to be packaged therein.

Technical Problem

In light, of the prior art, the technical problem addressed by the present invention consists in providing a fully automatic machine for creating customized packaging items, that can quickly create boxes of different dimensions, according to the products to be packaged.

DISCLOSURE OF THE INVENTION

The object of the present invention is to solve the aforementioned technical problem and obviate the above drawbacks, by providing a machine for automatically manufacturing customized packaging items that is highly efficient and relatively cost-effective.

A particular object of the present invention is to provide a machine for automatically manufacturing customized packaging in a fully automatic manner.

A particular object of the present invention is to provide a machine for automatically manufacturing customized packaging items that has a high hourly throughput, due to minimized adjustment times for its pick-up and forming members.

Yet another object of the present invention is to provide an automatic machine that can create a custom enclosure from a pack or coil of base sheet material.

A further object of the present invention is to provide a machine that can automatically release the formed packaging items without requiring any manual action by an operator.

Another important object of the present invention is to provide a machine for creating custom packaging items with two or more edges joined together.

These and other objects, as better explained hereafter, are fulfilled by a machine for automatically manufacturing customized packaging items as defined in claim 1.

Advantageous embodiments of the invention are obtained in accordance with the dependent claims.

BRIEF DESCRIPTION OF THE DRAWINGS

Further features and advantages of the invention will be more apparent upon reading of the detailed description of a machine for automated creation of custom packages, which is described as a non-limiting example with the help of the annexed drawings, in which:

FIG. 1A is a perspective view of a machine for automated creation of custom packages according to the invention in a first configuration;

FIG. 1B is a perspective view of a first enlarged detail of FIG. 1;

FIG. 2 is a top view of a machine for automated creation of custom packages according to the invention in a second configuration;

DETAILED DESCRIPTION OF A PREFERRED EMBODIMENT

Figure 3:
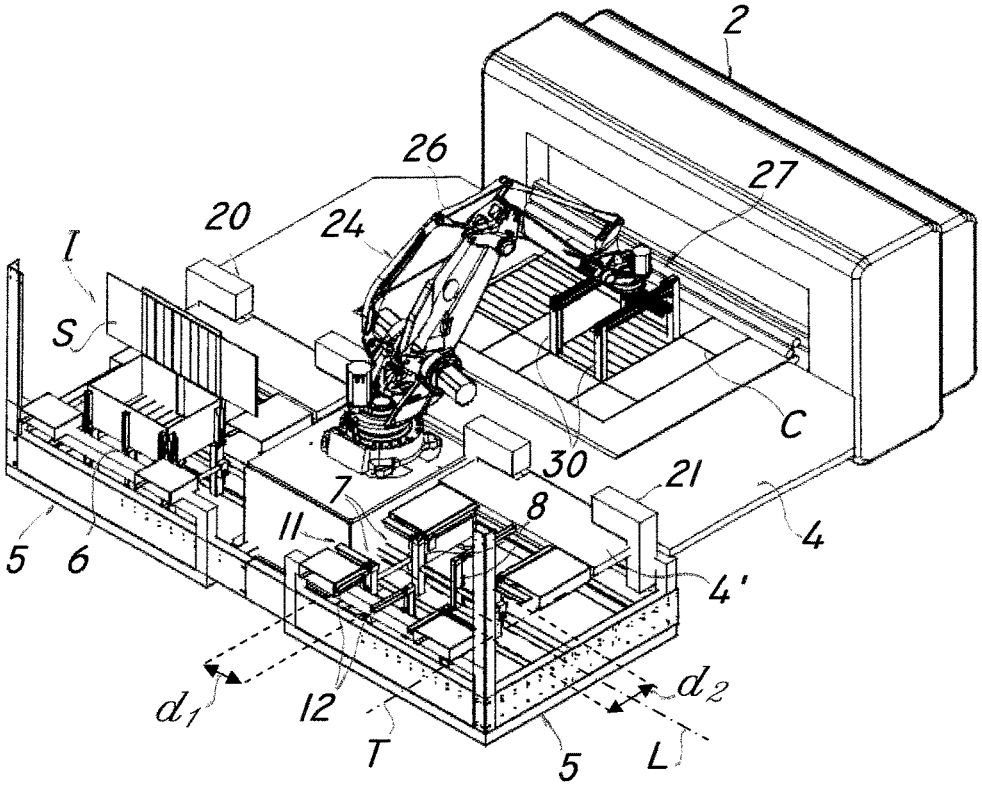
FIGS. 3 and 4 are perspective views of the machine of FIG. 1 in two different operating positions.

Particularly referring to the accompanying figures, a machine for automatic creation of packages I from continuous sheet material, such as corrugated cardboard or the like, is illustrated and generally designated by numeral 1.

The machine 1 is particularly suitable for creating custom packages I, according to user requirements and to the dimensions of the object to be packaged.

Furthermore, the machine 1 will be configured to create packages I from a continuous web of material that may be unwound from a coil, or folded in accordion-like pleats, with sheets joined at their edges folded upon themselves.

The machine 1 of the invention comprises a cutting and creasing unit 2 for cutting and creasing the continuous web to obtain one or more sheets F of material having a plurality of cuttings and/or bendinglines, generally referenced C and defining respective flaps S.

The cutting, unit 2 is designed to change both the dimensions of the sheet F being cut, and the position of the cuttings and bendinglines C according to the package I to be formed.

A plate 4 is provided at the exit 3 of the unit 2, for the sheet F of material to slide thereon once it has been cut and creased. In an alternative configuration of the invention, not shown, a device for customized ink-jet printing of images on one or more faces W of the sheet F of material may be installed between the exit 3 of the cutting and creasing unit 2 and the sliding plate 4.

Conveniently, the machine 1 comprises at least one variable-geometry die-forming unit 5 for forming the cut and creased sheet F and create package I having preset dimensions.

In a preferred embodiment of the invention, not shown, the machine 1 may comprise a single cutting and creasing unit 2 and two or more die-forming units 5 placed downstream from the sliding plate 4, for sequential or simultaneous formation of multiple packages I.

The die-forming unit 5 may have a die-forming cavity 6 of variable dimensions, substantially matching those of the package I to be created.

Particularly, as best shown in FIGS. 3 to 6B, the die-forming unit 5 may be adapted to form an erect custom package I from a cut and creased sheet F.

In this case, the die-forming cavity 6 will be delimited by a plurality of substantially vertical abutment members 7, each having a flat outer surface 8 adapted to interact with the sheet F to fold it along its bendinglines C.

In order to change the dimensions of the cavity 6, the abutment members 7 may be selectively movable in a longitudinal direction L and/or a transverse direction T in a predetermined range of values.

Therefore, appropriate positioning of the abutment members 7 will provide a cavity 6 of predetermined dimensions and geometry, e.g. a square or rectangular cavity.

In the die-forming unit 5 as shown in FIGS. 3 to 6A, the abutment members 7 may comprise a lower portion 9, formed by a plurality of vertical profiles 10 with one or more flat outer surfaces 8 interacting with the cut and creased sheet F.

The abutment members 7 may also comprise an upper portion 11 formed by a plurality of rods 12 hinged at the upper end 13 of the profiles 10.

These rods 12 may selectively rotate about a first horizontal rotation axis X between an inoperative lowered position, in which they are substantially horizontal and have coplanar outer surfaces 8 to define a plate 4' for the cut and creased sheet F to lie thereupon, and an operative lifted position in which they are substantially vertical and aligned with their respective profiles 10, with their outer surface 8 interacting with the sheet F to create the package I.

Furthermore, the abutment members 7 may be also vertically movable over a predetermined range, generally about 150 mm.

In an alternative configuration of the machine 1, the die-forming unit 5 may be configured to create folded packages I known as American-type packages.

This particular die-forming unit 5 is shown in FIGS. 7 to 11B, and its cavity 6 is delimited by abutment means 7 consisting of a pair of horizontal plates 14 with a flat top surface 8 adapted to define an abutment for the sheet F and a plurality of motorized actuators 15, that can selectively rotate relative to a corresponding horizontal rotation axis Y between an inoperative position, in which they do not contact the sheet F, and an operative position in which they interact with the sheet F to fold a flap S thereof into the cavity 6.

For example, a pair of actuators 15 may be provided at the periphery of the cavity 6, each having a plurality of transversely adjacent longitudinal bars 16, having a pitch p therebetween that can be adjusted according to the package I to be created.

The die-forming unit 5 will further have a plate 4' for the sheet F to be laid thereupon before being introduced into the die-forming cavity 6.

First motor means, not shown, are provided, which are associated with the abutment members 7 to change the longitudinal distance $d_1$ and the transverse distance $d_2$ therebetween.

If the die-forming unit 5 is of the type as shown in FIGS. 3 to 6B, the first motor means may promote selective and independent movement of the abutment members 7 in a longitudinal and/or transverse direction, lifting thereof, and rotation of the rods 12 relative to the corresponding rotation axis X.

However, if the die-forming unit 5 is of the type as shown in FIGS. 7 to 11B, the first motor means may promote longitudinal movement of the plates 14 and the actuators 15, and controlled rotation of the bars 16 about the axis Y.

Preferably, the machine 1 may also comprise unloading means 17 for unloading the package I, located at the die-forming station 5, for automatically releasing the package I once it has been formed.

In the die-forming unit 5 as shown in FIGS. 3 to 6B, the unloading means 17 may comprise one or more vertically movable surfaces 18, which are designed to lift the erect package I to thereby remove it from the cavity 6 and allow it to be manipulated by an external member.

Otherwise, in the alternative configuration of the die-forming unit 5 as shown in FIGS. 7 to 11B, the unloading means 17 may comprise a single 19 drive roller 19, frictionally interacting with one of the flaps S of the folded package I to cause it to come out of the cavity 6.

Furthermore, the machine 1 may comprise bonding means 20, which are adapted to distribute a layer of adhesive A on at least one flap S of the cut and creased sheets F, to promote adhesion with another flap S' thereof, and thereby form the package I.

In the configuration of the machine 1 as shown in FIGS. 3 to 6B, the bonding means 20 are located upstream from the die-forming unit 5 and comprise a bonding head, not shown, which is placed above the sliding plate 4 to distribute a line of adhesive A on the outermost edges S of the sheet F.

Furthermore, the machine 1 may also comprise one or more die cutters, also not shown, which are adapted to interact with one or more flaps S of the sheet F to reduce their dimensions.

Preferably, the bonding heads and the die cutter may be housed within the same box-like enclosure 21, which is secured in cantilever fashion above the sliding plate 4.

In the different embodiment of the die forming unit 5 as shown in FIGS. 7 to 11B, the bonding means 20 comprise a head for distribution of the adhesive A, not shown, which is mounted at the end 22 of a transversely movable arm 23, located substantially at the center of the cavity 6.

According to a peculiar aspect of the invention, a multifunctional manipulator 24 is provided, which is adapted to automatically pick up one sheet F at a time from the cutting and creasing unit 2, and feed it to the die-forming unit 5.

Furthermore, the manipulator 24 is designed to automatically adapt to the dimensions preset in the die-forming unit 5 to interact therewith for forming the package I.

Preferably, as better shown in the figures, the manipulator 24 comprises a fixed base 25, generally placed between two adjacent die-forming stations 5 that are fed by the same cutting and creasing unit 2 and an anthropomorphic motorized arm 26 which is adapted to rotatably support a movable head 27.

The movable head 27 may comprise a plurality of suction cups 28, as schematically shown in the figures, which are connected to respective suction means, not shown, to promote a gripping action on the sheet F at the exit of the cutting and creasing unit 2 and release thereof into the die-forming cavity 6.

Thus, the machine 1 will create custom packages I in a fully automated manner, without requiring the operator to transfer the cut and creased sheet F to the die-forming unit 5.

Furthermore, the head 27 may comprise a generally longitudinal upper beam 29, for supporting a plurality of substantially vertical pressure members 30, which are designed to penetrate the die-forming cavity 6 once the sheet S has been positioned in the die-forming unit 5.

These pressure members 30 can be adjusted both in the longitudinal direction L, substantially parallel to the beam 29, and in the transverse direction T to adapt to the dimensions of the die-forming cavity 6.

Conveniently, the suction cups 28 may be arranged at the free bottom and 31 of the pressure members 30.

Advantageously, the machine 1 may comprise second motor means 32 associated with the vertical pressure members 30 of the head 27, to selectively change the longitudinal distance $d_3$ and the transverse distance $d_4$ therebetween.

Thus, the distances $d_3$, $d_4$ between the pressure members 30 will be controlled to be substantially equal to the dimensions of the cavity 6, which in turn match those of the package I to be created.

The machine 1 may further comprise electronic control means 33, comprising an interface unit 34 that is designed to be actuated by the user to set the dimensions of the package I.

The control means are electrically connected to the cutting and creasing means 2, for the cuttings and the bendinglines C to be made in the proper positions, with reference to a given preset package I.

Furthermore, the electronic control means 33 will be also connected to the first and the second motor means 32 to automatically change the distances $d_1$, $d_2$ of the abutment members 7 and the distances $d_3$, $d_4$ of the pressure members certainty according to the dimensions of the package I.

Preferably, the electronic control means 33 may comprise a microprocessor unit 35, for controlling both the movement of the manipulator 24 and the first and second motor means 32 during formation of the package I in the die forming unit 5.

For example, the microprocessor unit 35 may control the vertical movement of the abutment means 7, as well as the rotation of the rods 12 and the actuators 15 about their respective rotation axes X, Y.

Figure 5A:
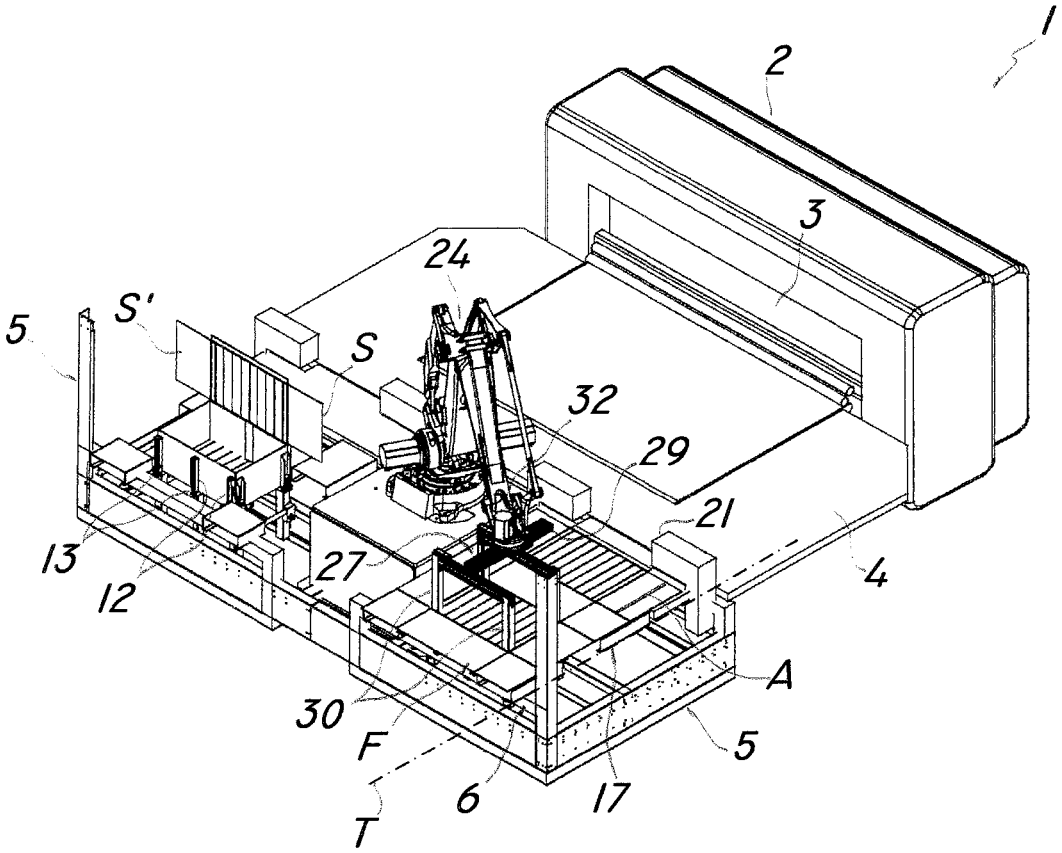
FIGS. 5A and 5B are perspective views of the machine of FIG. 1 in a further operating position.

In operation, if the plant 1 is configured to create an erect package I, the sheet F at the exit 3 of the cutting and creasing unit 2 will be picked up by the manipulator 24 and moved into the die-forming unit 5, as shown in FIGS. 3 and 5A.

Figure 4:
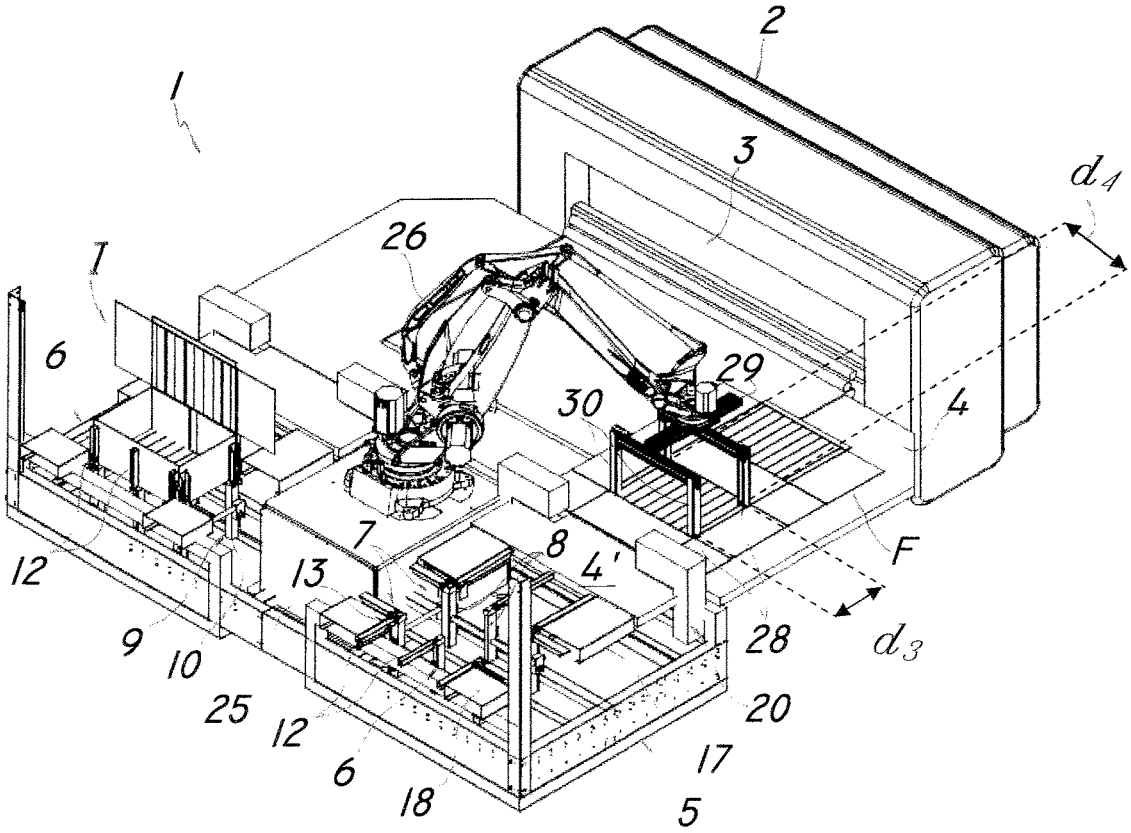

Before reaching this unit 5, the sheet F will be moved by the manipulator 24 below the bonding heads, if applicable, as schematically shown in FIG. 4. Thus, the sheet S will reach the die-forming unit 5 in a die-cut state, with a layer of adhesive A on at least one flap. S.

Figure 5B:
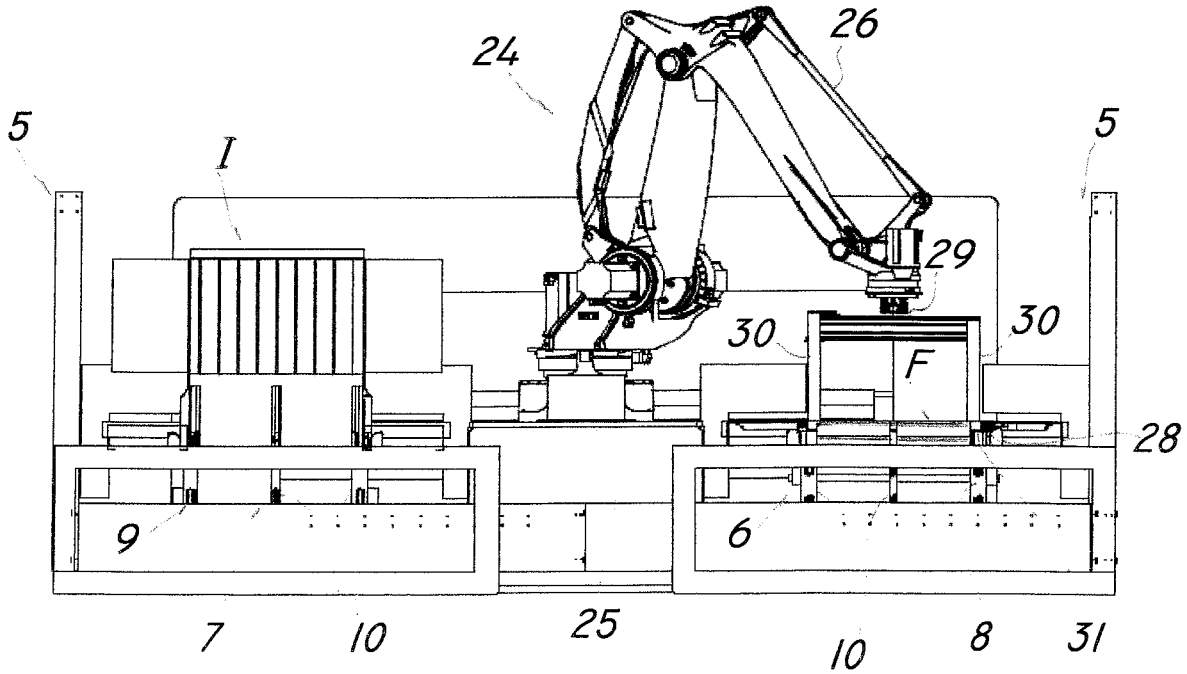

In this processing step, the die-forming unit 5 will have the abutment members 7 lowered, with the rods 12 in the inoperative position, to define the plate 4' for the F to lie thereupon F, as well shown in FIG. 5B.

Also, the manipulator 24 will place the sheet F on the die-forming unit 5, so that the portion designed to form the bottom wall of the package I will be centered relative to the cavity 6.

Figure 6A:
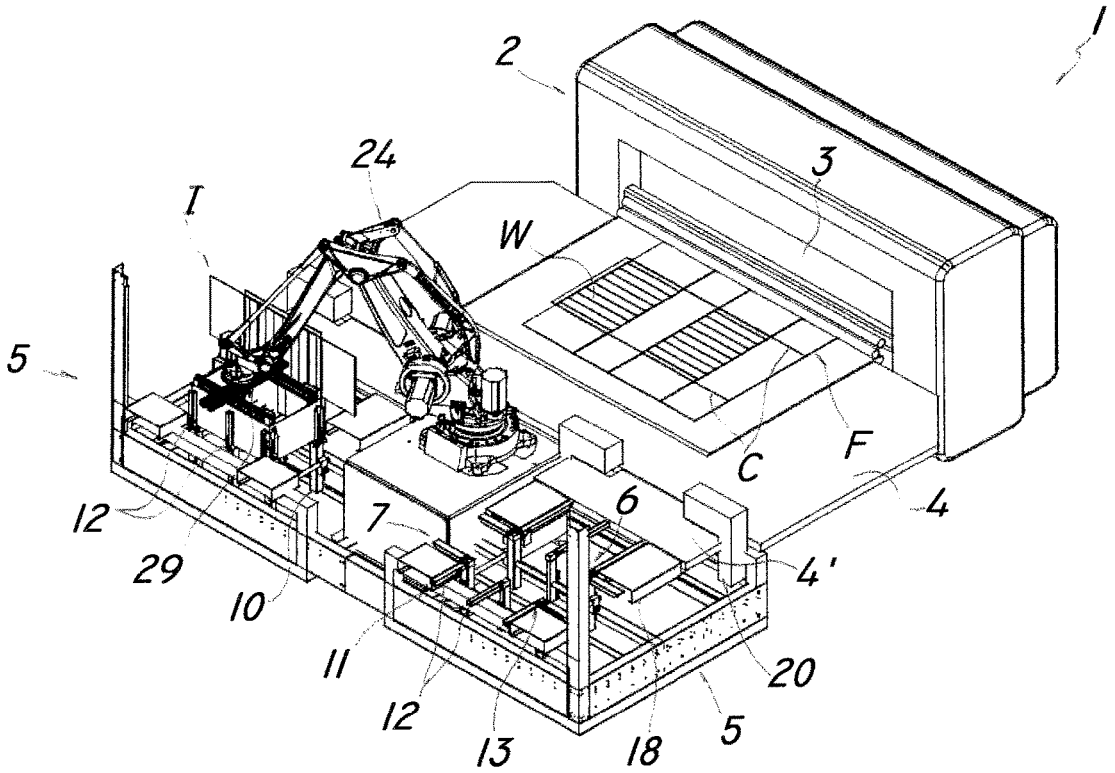
FIGS. 6A and 6B are perspective views of the machine of FIG. 1 in a further operating position.
Figure 6B:
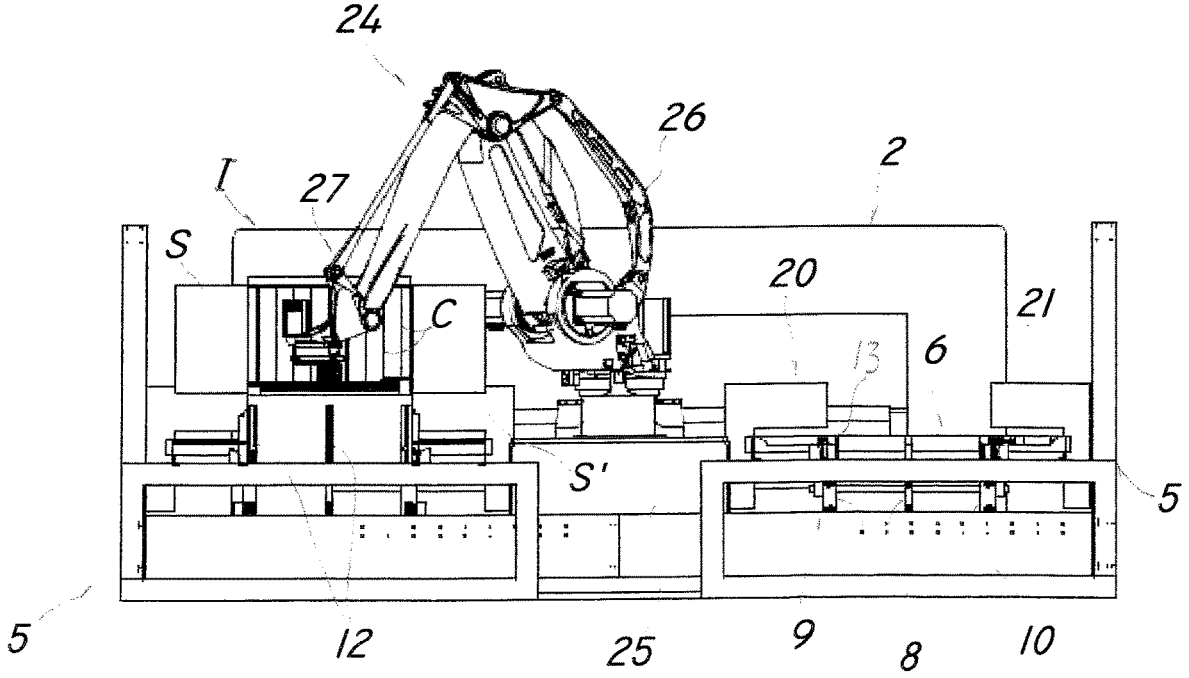

Then, the manipulator 24 will promote the controlled descent of the head 27 so that, by the action of the pressure members 30, the sheet F will progressively penetrate the cavity 6, as shown in FIGS. 6A and 6B.

As the head 27 moves downwards, the first motor means will promote the rise of the abutment members 7 and the controlled rotation of the rods 12 from the inoperative position to the operative position, to thereby cause the sheet F to be folded along the foldline C to form the erect package I.

Also, during forming, the flap S with the adhesive A will overlap another flap S' of the sheet F to form an erect package I with the side walls and the bottom wall closed.

At the end of the forming step, the suction cups 28 will release the package I so formed and the manipulator 24 will move to a position external to the die-forming unit 5 and be ready to pick up a new sheet F at the exit 3 of the cutting and creasing unit 2.

Then, as the movable surfaces 18 of the unloading means 17 are lifted, the erect package I will be removed from the die-forming cavity 6.

Figure 7:
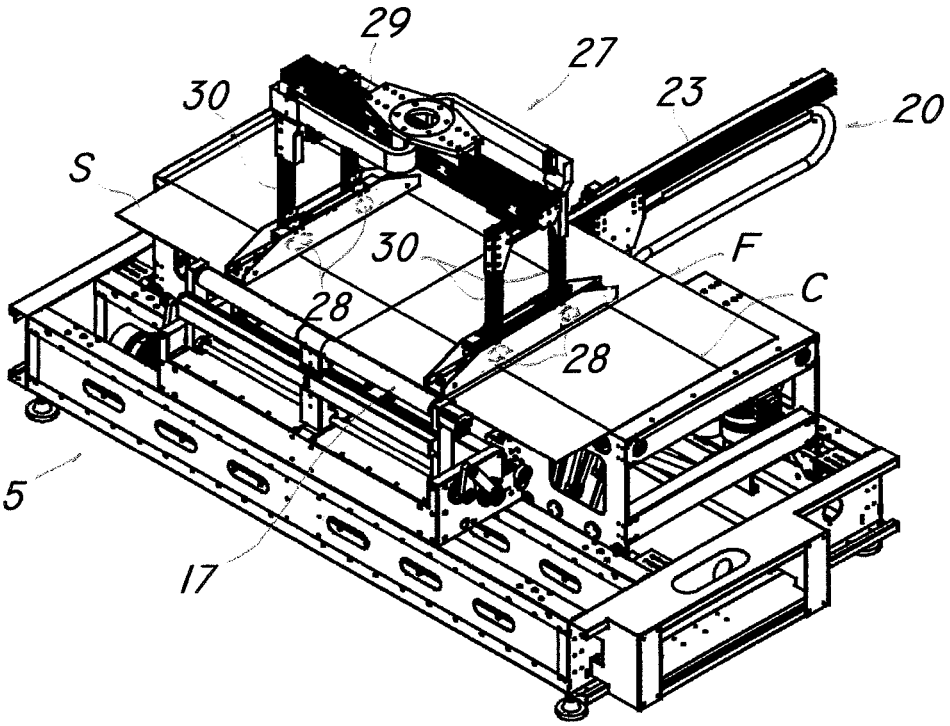
FIGS. 7 and 8 are perspective views of a second detail of FIG. 2, in two different operating positions.

If the plant 1 is configured to create a folded package I, the latter will be picked up by the manipulator 24, due to the adhesion of the suction cups 28, at the exit of the cutting and creasing unit 2, and will be placed on the plate 4', as shown in FIG. 7.

If needed, the manipulator 24 may promote a 90° rotation of the sheet F before placing it on the die-forming unit 5.

Figure 8:
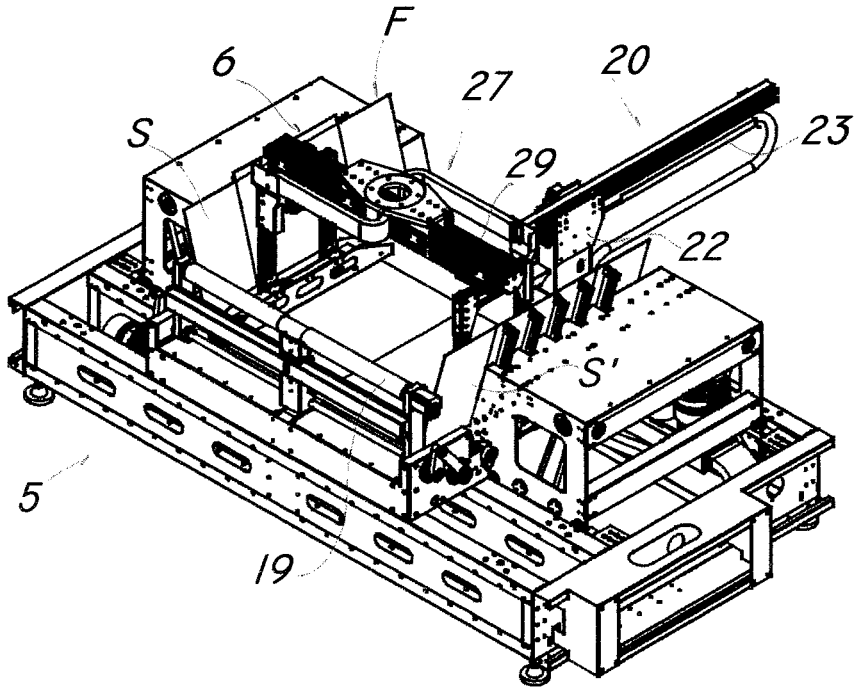

Then, the manipulator 24 will promote the controlled descent of the head 27 so that, upon the action of the pressure members 30, the sheet F will progressively penetrate the cavity 6 until it abuts the top surface 8 of the horizontal plates 14, as shown in FIG. 8.

Now, the suction cups 28 will release the sheet F and the manipulator 24 will move to a position external to the die-forming unit 5 and be ready to pick up a new sheet F at the exit 3 of the cutting and creasing unit 2.

Figure 9A:
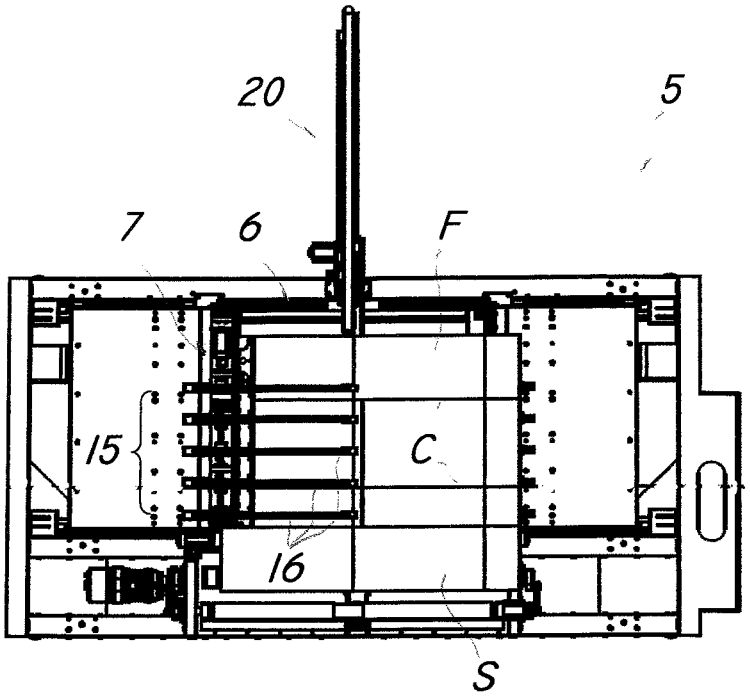
FIGS. 9A and 9B are perspective views of the detail of FIG. 7 in a further operating position.
Figure 9B:
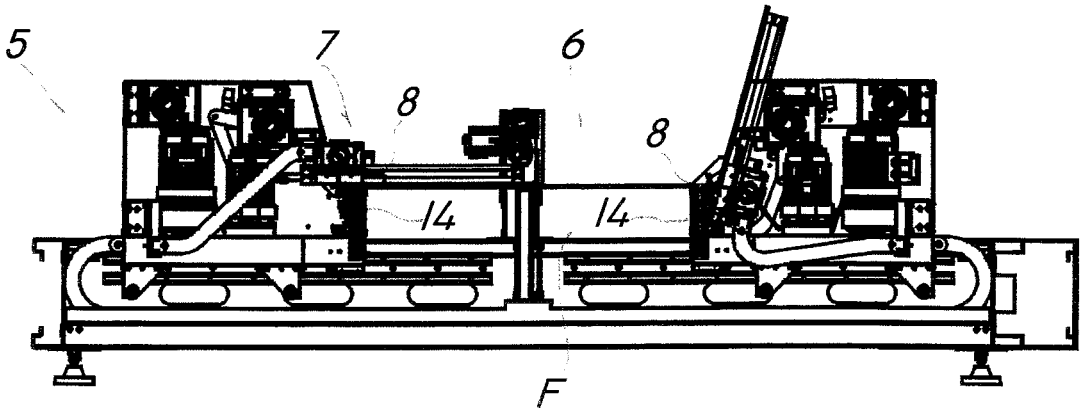

Then, the first rotor means will promote controlled rotation of an actuator 15 about its rotation axis Y from the inoperative position to the operative position, so that the corresponding flap S of the sheet F may be folded into the cavity 6 and over the portion that lies on the horizontal plates 14, as shown in FIGS. 9A and 9B.

Figure 10:
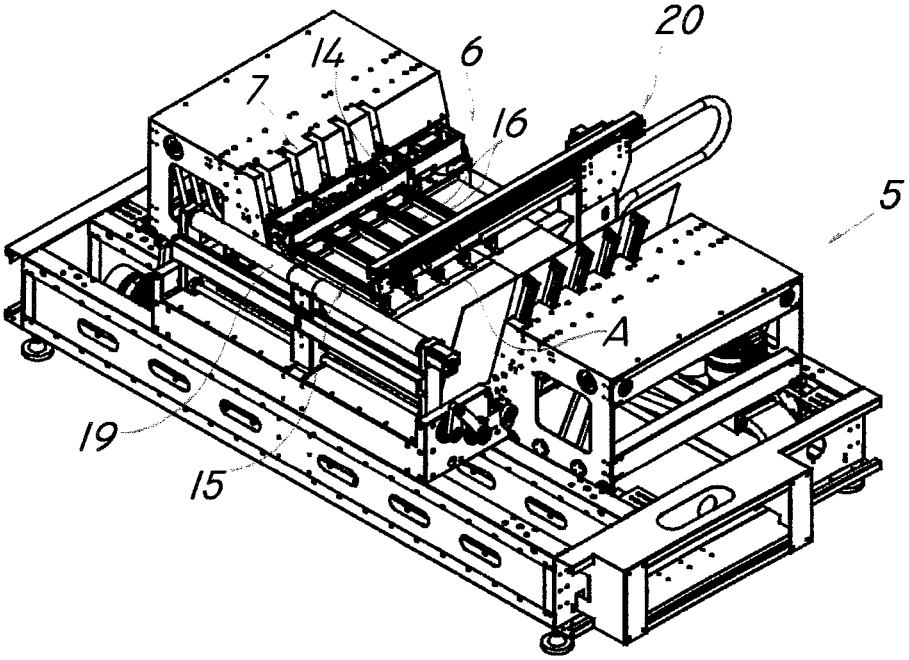
FIGS. 10; 11A and 11B are perspective views of the detail of FIG. 7 in two further operating positions.

Later, as best shown in FIG. 10, the movable arm 23 that supports the bonding head will be actuated, to distribute the adhesive A on the outer face W of the flap S so folded.

Figure 11A:
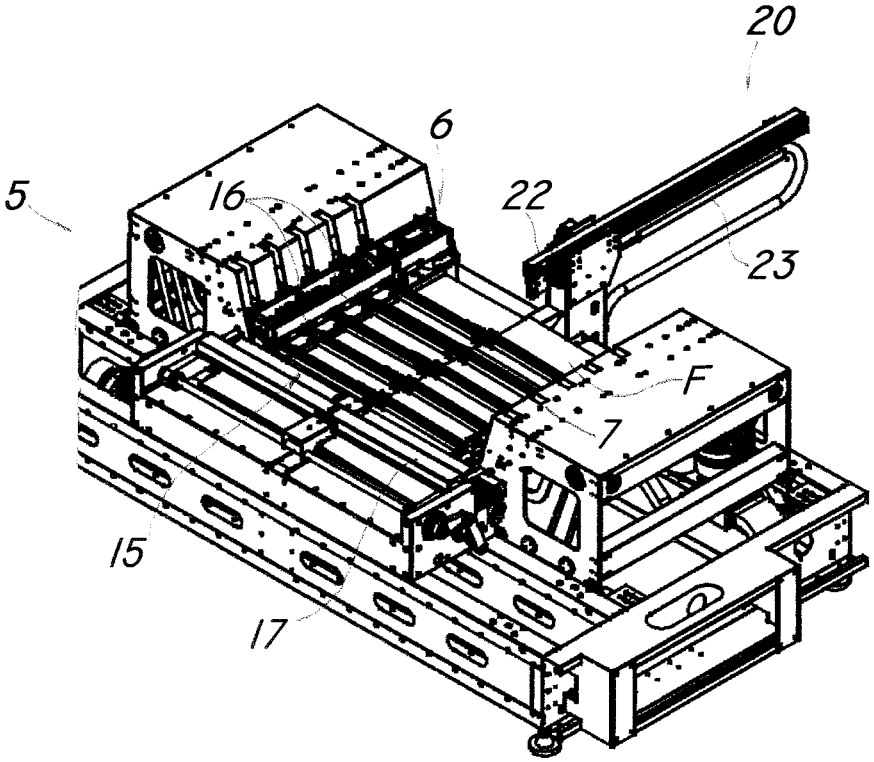
Figure 11B:
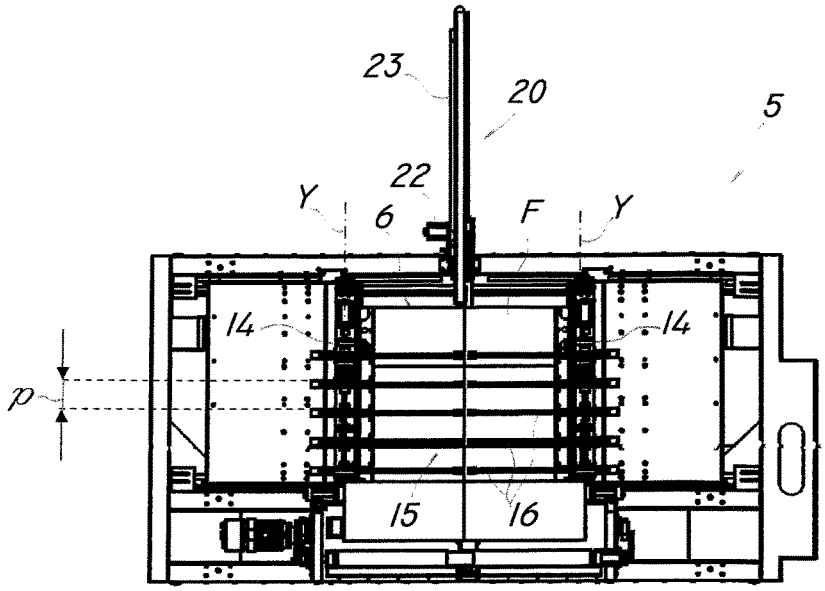

Now, the first motor means will promote the rotation of the other actuator 15 about its rotation axis Y from the inoperative position to the operative position, for a different flap 5' of the sheet F to be folded and adhered to the previously folded flap S coated with the adhesive A, as best shown in FIG. 11A.

Finally, the drive roller 19 will be rotated about its axis Z to promote removal of the folded package I and pressing of the two flaps S, S' so bonded.

Figure 12:
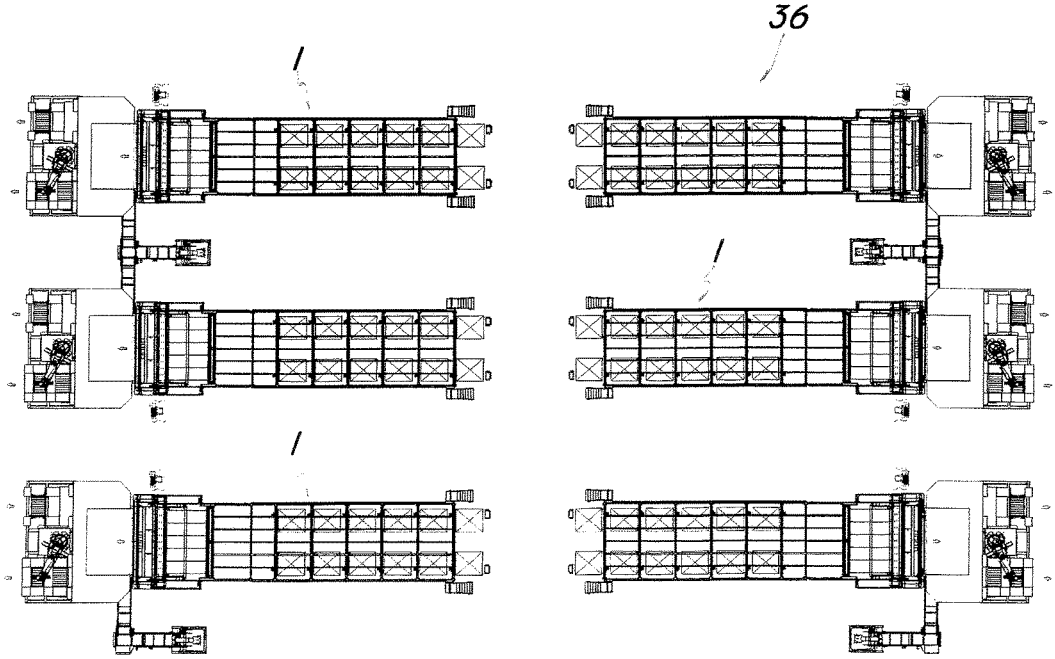
FIG. 12 is a top view of a plant composed of a plurality of machines for automated creation of custom packages as shown in FIG. 1 and/or FIG. 2.

As shown in FIG. 12, a modular plant 36 may be provided, for automated production of custom packages I from sheet material. Such plant 36 has a plurality of machines 1 as described above, arranged in side-by-side relationship, each having a cutting and creasing unit 2, a manipulator 24 and two or more die-forming units 5 for forming the package.

Therefore, the plant 36 will greatly increase the overall throughput, as it will simultaneously provide multiple custom packages, each created by a single machine.

The machine of the invention is susceptible of a number of changes and variants, within the inventive concept disclosed in the appended claims. All the details thereof may be replaced by other technically equivalent parts, and the materials may vary depending on different needs, without departure from the scope of the invention.

While the machine has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be manufactured on an industrial scale in factories for production of machines designed for processing of semirigid sheet products, such as cardboard or the like, or for production of package-forming machines.

The invention claimed is:

1. A machine for automated creation of custom packages from continuous sheet material, such as corrugated cardboard, which machine comprises at least the following units:

a cutting and creasing unit to form sheets of material with a plurality of cuttings and/or bending lines;

at least one variable-geometry die-forming unit for forming the cut and creased sheet and create a package having preset dimensions; and a multifunctional robotized manipulator for automatically picking up one sheet at the time from the cutting and creasing unit and feeding said die-forming unit, said manipulator being designed to automatically adapt to the dimensions of the package that have been preset on said die-forming unit and interact therewith to form the package, wherein:

said die-forming unit has a die-forming cavity having variable dimensions, matching those of the package to be created;

said manipulator comprises an anthropomorphic arm, connected to a fixed base and adapted to rotatably support a movable head; and said head comprises a beam for supporting a plurality of substantially vertical pressure members, which are designed to penetrate said die-forming cavity once the sheet has been positioned in said die-forming unit, said pressure members being adjustable in the directions substantially parallel and transverse to said beam to adapt to the dimensions of said die-forming cavity.

2. A machine as claimed in claim 1, wherein said die-forming cavity is delimited by a plurality of abutment members having a substantially flat outer surface designed to interact with the sheet to fold it along the bending lines, said abutment members being selectively movable in a longitudinal direction and a transverse direction to change the dimensions of the said cavity.

3. A machine as claimed in claim 2, further comprising first motor means associated with said abutment members of said cavity to change the longitudinal distance and the transverse distance therebetween.

4. A machine as claimed in claim 1, wherein said head comprises a plurality of suction cups connected to suction means that are designed to be selectively actuated to promote a gripping action on the sheet in said cutting and creasing unit and release thereof into said die-forming cavity.

5. A machine as claimed in claim 1, further comprising second motor means associated with said vertical pressure members of said head to change the longitudinal distance and the transverse distance therebetween.

6. A machine as claimed in claim 5, further comprising electronic control means comprising an interface unit that is designed to be actuated by the user to set the dimensions of the package, said control means being connected to said cutting and creasing means as well as to said first and second motor means for synchronized adaptation of the positions of said cuttings and/or bending lines on the sheet and the distances of said abutment members and the distances of said pressure members according to the dimensions of the package.

7. A machine as claimed in claim 1, further comprising bonding means, adapted to distribute a layer of adhesive A on at least one edge of the cut and creased sheets, to promote adhesion with another flap, and thereby form the package.

8. A machine as claimed in claim 1, further comprising means for automatically unloading the package from said cavity, once it has been formed.

9. A machine as claimed in claim 1, further comprising a plurality of die-forming units downstream from said cutting and creasing unit, said manipulator being adapted to feed said plurality of die-forming units one at a time.

* * * * *